US011718512B2

(12) United States Patent
Borcheller

(10) Patent No.: US 11,718,512 B2
(45) Date of Patent: Aug. 8, 2023

(54) VEHICLE WHEEL ELEVATING DOCK

(71) Applicant: Design Dynamics, Inc., Vero Beach, FL (US)

(72) Inventor: Terry Borcheller, Vero Beach, FL (US)

(73) Assignee: Design Dynamics Inc., Vero Beach, FL (US)

( * ) Notice: Subject to any disclaimer, the term of this patent is extended or adjusted under 35 U.S.C. 154(b) by 72 days.

(21) Appl. No.: 16/804,571

(22) Filed: Feb. 28, 2020

(65) Prior Publication Data

US 2021/0047160 A1 Feb. 18, 2021

Related U.S. Application Data

(60) Provisional application No. 62/886,488, filed on Aug. 14, 2019.

(51) Int. Cl.
*B66F 7/24* (2006.01)
*B66F 7/28* (2006.01)

(52) U.S. Cl.
CPC ..... *B66F 7/243* (2013.01); *B66F 7/28* (2013.01)

(58) Field of Classification Search
CPC .... B66F 7/243; B66F 7/28; B66F 7/24; B60C 27/003
USPC ..... 254/88
See application file for complete search history.

(56) References Cited

U.S. PATENT DOCUMENTS 6,135,420 A * 10/2000 Johnston ..... B66F 7/243 254/88
6,520,344 B2 * 2/2003 Graham ..... B66F 7/243 211/20
7,854,032 B2 * 12/2010 Igwemezie ..... B66F 7/243 14/69.5
8,002,241 B1 8/2011 Shaw
8,978,519 B2 * 3/2015 Hard ..... B60C 27/003 81/15.8
9,868,622 B1 1/2018 Turner
10,166,459 B1 1/2019 Chen
2005/0000042 A1 1/2005 Marko
2008/0201873 A1 * 8/2008 Haimoff ..... B66F 7/243 14/69.5
2018/0029856 A1 2/2018 Muth

FOREIGN PATENT DOCUMENTS

EP 2331374 A2 6/2011
GB 2281277 A 3/1995

OTHER PUBLICATIONS

European Patent Office, International Search Report, Application No. PCT/US2020/070406, dated Dec. 9, 2020.

* cited by examiner

*Primary Examiner* — Lee D Wilson
*Assistant Examiner* — Michael A Gump
(74) *Attorney, Agent, or Firm* — Daniel C. Pierron; Widerman Malek, PL

(57) ABSTRACT

A wheel elevating dock including a body member, a first plurality of ramp members attached to a first end of the body member and defining gaps between each ramp member of the first plurality of ramp members, and a second plurality of ramp members attached to a second end of the body member. The gaps defined by the first plurality of ramp members are configured to permit ramp members from an adjacent wheel elevating dock to be positioned within the gaps.

19 Claims, 4 Drawing Sheets

VEHICLE WHEEL ELEVATING DOCK

RELATED APPLICATIONS

This application claims priority under 35 U.S.C. § 119(e) of U.S. Provisional Patent Application Serial No. 4443.00002) filed on Aug. 14, 2019 and titled Vehicle Wheel Elevating Dock. The content of this application is incorporated herein by reference.

FIELD OF THE INVENTION

The present invention relates to devices for elevating vehicle wheels while parked.

BACKGROUND OF THE INVENTION

The issue of tire dry rot, where a tire on a vehicle decays due to consistent exposure to harmful environmental factors, including water on a ground surface, is well known in the industry. Previous solutions have included a dock that elevates a tire from the ground surface but have included a number of shortcomings. These shortcomings include a configuration that prevents multiple docks from being used immediately adjacent to one another, thereby making their use with vehicles that have tires immediately adjacent problematic. Additionally, previous solutions have been difficult to remove from the ground due to a lack of structures for the user to grip the solution after use.

Further shortcomings include compromises in either the structural integrity of the device in order to provide drainage capabilities, or not including such draining capabilities, thereby potentially causing the same kinds of rot-inducing conditions that are sought to be avoided. Additionally, the low-profile nature of previous solutions has made visible identification of the solution difficult, particular when the vehicle is being transitioned onto the solution, or clearly determining at a distance if the vehicle has a dock underneath a given tire. These and other shortcomings are addressed in the present invention.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention are related to a wheel elevating dock comprising a body member, a first plurality of ramp members attached to a first end of the body member and defining gaps between each ramp member of the first plurality of ramp members, and a second plurality of ramp members attached to a second end of the body member. wherein the gaps defined by the first plurality of ramp members are configured to permit ramp members from an adjacent wheel elevating dock to be positioned within the gaps.

In some embodiments, the ramp members of the first and second pluralities of ramp members may have a peak height section configured to have a height greater than a height of an upper surface of the body member.

In some embodiments, the body member may comprise a plurality of sidewalls and a plurality of interior walls. In further embodiments, the plurality of sidewalls and the plurality of interior walls may cooperate to define a plurality of cells. A cell of the plurality of cells may comprise an aperture configured to permit the flow of fluid out of the cell. In some embodiments, each cell may comprise a plurality of cell sidewalls and a cell lower wall. The aperture may be positioned at an intersection of adjacent cell sidewalls and the cell lower wall. Additionally, in some embodiments, each cell of the plurality of cells may comprise an aperture configured to permit the flow of fluid out of the cell.

In some embodiments, wherein the plurality of sidewalls and plurality of interior walls are arranged in a grid. In some of those embodiments, at least one cell of the plurality of cells may comprises a plurality of cell sidewalls and a lower aperture defined by the plurality of sidewalls. The wheel elevating dock may further comprise one of a foot positioned within the lower aperture and a caster positioned within the lower aperture.

In some embodiments, a sidewall of the plurality of sidewalls may comprise a recess formed on a lower edge thereof. In some embodiments, the body member may further comprise an upper surface and an aperture formed in at least one of a sidewall of the plurality of sidewalls and the upper surface. The body member may comprise two pairs of apertures formed at opposing ends of the upper surface.

In some embodiments, the plurality of interior walls may comprise a plurality of longitudinally-oriented walls and a plurality of latitudinally-oriented walls. A subset of the longitudinally-oriented walls may have a width that is greater than widths of the other longitudinally-oriented walls and the latitudinally-oriented walls.

In some embodiments, the second plurality of ramp members may be configured to have a width and be positioned so as to fit within gaps defined by ramp members of an adjacent wheel elevating dock.

BRIEF DESCRIPTION OF THE DRAWINGS

Some embodiments of the present invention are illustrated as an example and are not limited by the figures of the accompanying drawings, in which like references may indicate similar elements.

DETAILED DESCRIPTION OF THE INVENTION

Figure 1:
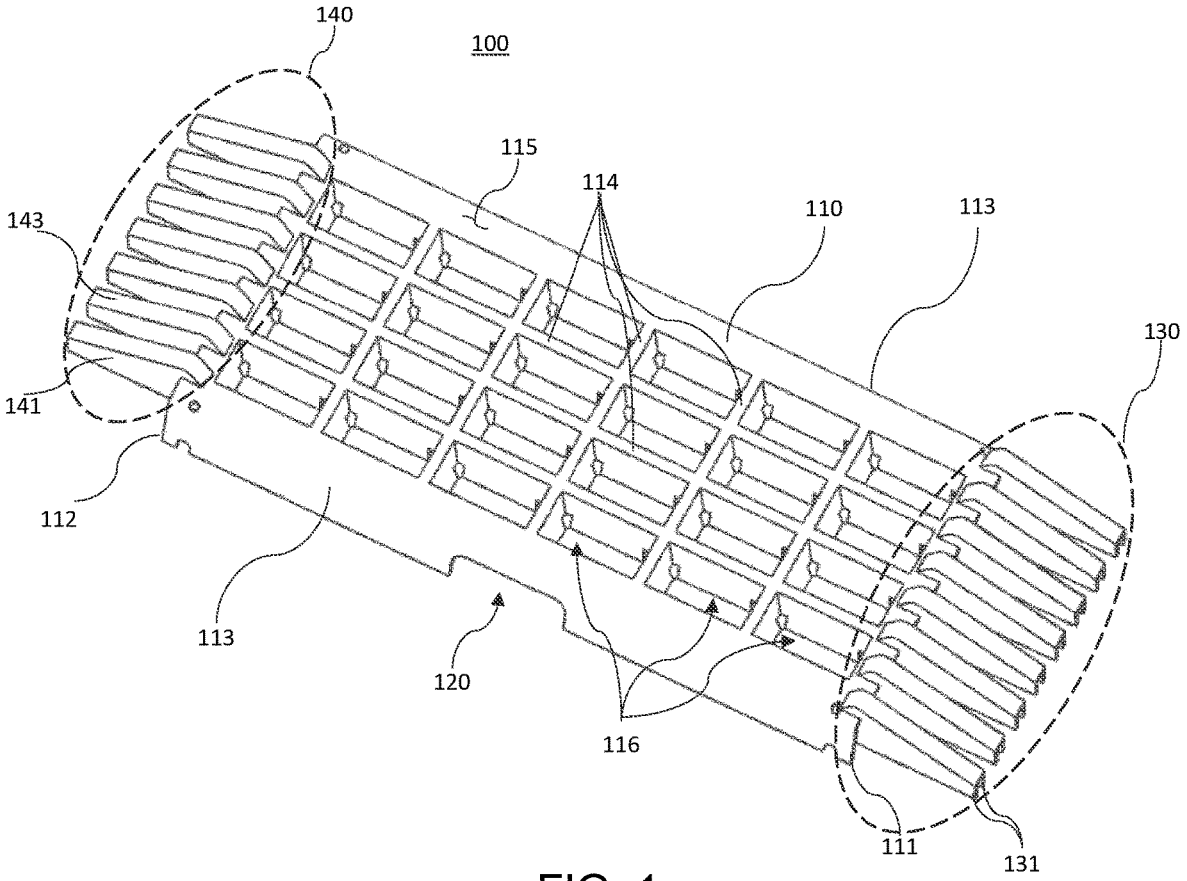
FIG. 1 is a perspective view of a dock according to an embodiment of the invention.
Figure 2:
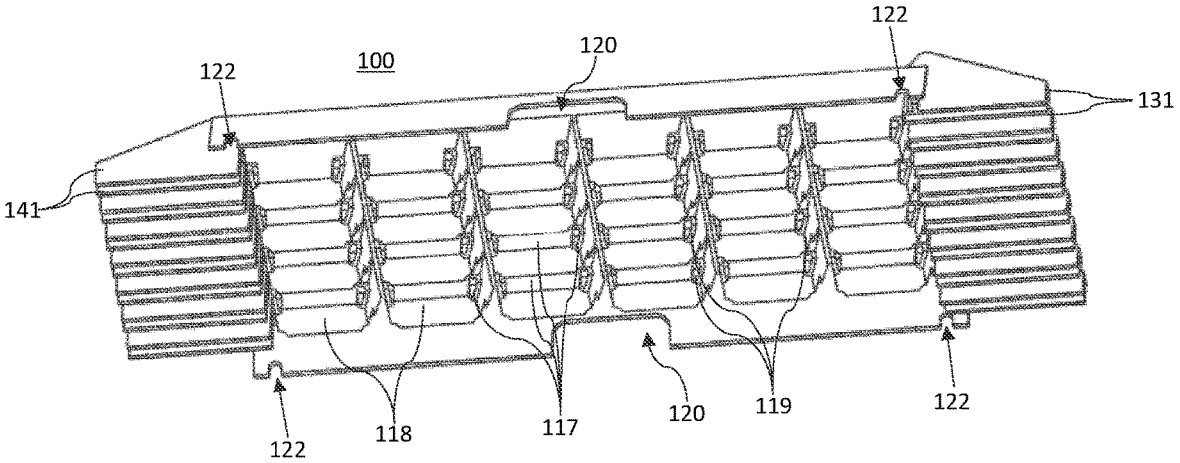
FIG. 2 is a lower perspective view of the dock of FIG. 1.
Figure 3:
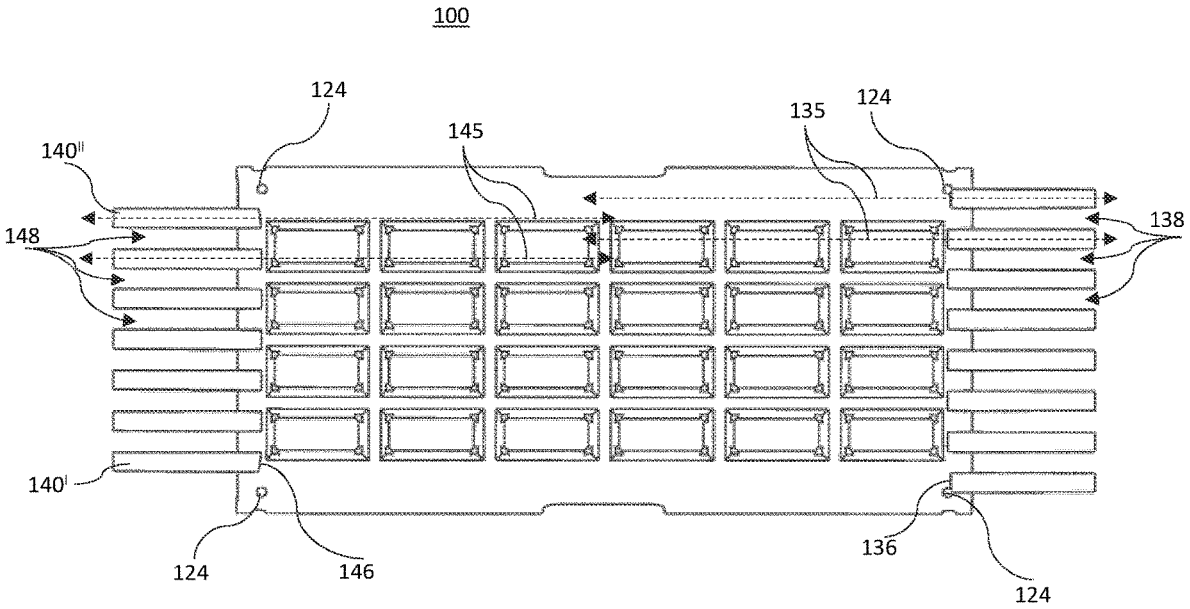
FIG. 3 is a top view of the dock of FIG. 1.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

Furthermore, in this detailed description, a person skilled in the art should note that quantitative qualifying terms such as "generally," "substantially," "mostly," and other terms are used, in general, to mean that the referred to object, characteristic, or quality constitutes a majority of the subject of the reference. The meaning of any of these terms is dependent upon the context within which it is used, and the meaning may be expressly modified.

An embodiment of the invention, as shown and described by the various figures and accompanying text, provides a ramped dock for elevating wheels of vehicles while parked.

Referring now to FIGS. 1-4, a dock 100 according to an embodiment of the invention is presented. The dock 100 may comprise a body member 110, a first plurality of ramp members 130 attached to a first end 111 of the body member 110, and a second plurality of ramp members 140 attached to a second end 112 of the body member 110. The dock 100 may be formed of a material that resists corrosion due to environmental factors and/or chemical interaction with common vehicle tire/wheel materials, including rubber (both synthetic and natural), rubber composites, carbon black, metals, metal alloys, and any other material as is used in wheel/tire fabrication. In the current embodiment, the dock 100 may be formed of a polymer, specifically polyamide with fiber glass reinforcement or a polyolefin. The dock 100 may have an overall length within a range from 16 inches to 42 inches, a width within a range from 6 inches to 32 inches, and a height within a range from 1.25 inches to 5 inches.

The body member 110 may comprise sidewalls 113, a plurality of interior walls 114, and an upper surface 115. The plurality of interior walls 114 may be arranged in a grid pattern and may cooperate to define a plurality of cells 116. The plurality of interior walls 114 may have a thickness sufficient to prevent crushing from the force exerted upon the upper surface 115 by the positioning and parking of a wheel/tire thereupon and supporting the vehicle to which the wheel/tire is attached. Such thickness may depend upon the properties of the material used in forming the plurality of interior walls 114. The body member 110 may have a length within a range from 7 inches to 33 inches and a width within a range from 6 inches to 32 inches. In the present embodiment, the body member 110 has a length of 32 inches and a width of 11.25 inches. Additionally, the body member 110 may have a height within a range from 1 inch to 4 inches, with the present embodiment having a height of approximately 2.375 inches.

In the current embodiment, the upper surface 115 may be generally flat and rectangular in shape. It is contemplated and included within the scope of the invention that the upper surface 115 may be curved, thereby conforming, to some degree, to the shape of a wheel/tire positioned on the dock 100. Additionally, in some embodiments, the upper surface 115 may have a shape that is not rectangular. In some embodiments, a latitudinal center of the upper surface 115 may have a dimension that is greater than a dimension of one or both of the ends of the body member 110. All potential shapes of the upper surface 115 are contemplated and included within the scope of the invention.

The plurality of interior walls 114 may define the plurality of cells 116 by defining cell sidewalls 117 and a lower wall 118 for each cell. In the present embodiment, the plurality of cells 116 may have a generally rectangular geometric configuration. Other geometric configurations are contemplated and included within the scope of the invention, including, but not limited to, hexagonal, circular/spherical, and any other regular or non-regular shape. Furthermore, while the current embodiment has a flat lower surface, it is contemplated and included within the scope of the invention that the lower surface may be curved. Additionally, in the current embodiment, the cell sidewalls 117 are angled slightly inward towards a center of the cell 116. It is contemplated and included within the scope of the invention that the cell sidewalls may be vertical or angled slightly outward from the center of the cell 116. The cells 116 may have an upper opening having a length within a range from 1.5 inches to 7 inches and a width within a range from 0.875 inches to 3.5 inches. In the present embodiment, the opening of the cells 116 has a length of 3.375 inches and a width of 1.75 inches.

The plurality of interior walls 114 may further define one or more apertures 119 associated with each cell of the plurality of cells 116. The apertures 119 may permit the outflow of material that may enter the plurality of cells 116, such as precipitation, dirt, pollen, and other environmental factors. By permitting such outflow, the degradation of the wheel/tire positioned upon the dock 100 may be slowed by minimizing the duration the wheel/tire is put into contact with such environmental factors, thereby extending the useful life of the wheel/tire. The apertures 119 may be dimensioned so as to minimize the negative structural impact to the plurality of interior walls 114. Additionally, in the current embodiment, the apertures 119 are positioned at the intersection of adjacent cell sidewalls 117 and the lower wall 118. Any other positioning of the apertures 119, including in only one of the cell sidewalls 117 or the lower wall 118, or at the intersection of one cell sidewall 117 and the lower wall 118, is contemplated and included within the scope of the invention.

Each sidewall 113 may comprise a first recess 120. The first recess 120 may be formed at approximately the middle along the length of the sidewall 113 at a lower edge thereof, defining a void that may be utilized by a user to facilitate lifting the dock 100 off the ground.

Each sidewall 113 may further comprise second recesses 122. The second recesses 122 may be formed in the lower edge of the sidewall 113 towards opposite ends thereof. The second recesses 122 may be configured to facilitate the removable attachment of additional devices to the dock 100. For example, hooks attached to elastic bands may be removably attached to the second recesses. The elastic bands may further be attached to any number of structures, including tire/wheel covers, automobile covers, and the like.

The body member 110 may further comprise a plurality of apertures 124. The apertures 124 may be formed in one or both of the sidewalls 113 and the upper surface 115 and located towards opposite ends of the body member 110. In the current embodiment, four apertures are formed at opposite corners of the body member 110. Any number and distribution of apertures 124 is contemplated and included within the scope of the invention. The apertures 124 may be configured to permit the placement of structures therethrough. In some embodiments, a rod having a flag at one end may be positioned through an aperture to provide a visual indication of the presence of the dock 100. In another embodiment, a wall structure having two rods extending downwards that may be positioned through two aperture 124 at an end of the dock 100. The wall structure may facilitate the positioning of the wheel/tire on the dock 100 and/or prevent or inhibit a wheel/tire positioned on the dock 100 from rolling off the dock 100. Accordingly, so as not to interfere with the first and second pluralities of ramp members 130, 140, the apertures 124 may be positioned such that a wall structure positioned as described will not interface with or be interfered by the ramp members, i.e. positioned inward/longitudinally towards a longitudinal center of the body member 110 such that proximate ramp members are generally outward of the apertures 124.

The first and second pluralities of ramp members 130, 140 may be configured to facilitate the positioning of a wheel/tire on the dock 100. Each ramp member may comprise an outer end 132, 142, a peak height section 134, 144, and an inner end 136, 146. The ramp member may be attached to the body member at and in the area of the inner end 136, 146. In some embodiments, the ramp members may be integrally formed with the body member 110. Each ramp member of the first plurality of ramp members 130 may define a centered lateral axis 135. Each centered lateral axis 135 may run along a lateral length of and be positioned at a center line of a ramp member of the first plurality of ramp members 130. Similarly, each ramp member of the second plurality of ramp members 140 may define a centered lateral axis 145. Each centered lateral axis 145 may run along a lateral length of and be positioned at a center line of a ramp member of the second plurality of ramp members 140. Each of the centered lateral axes 135 of the first plurality of ramp members 130 may be longitudinally offset from each of the centered lateral axes 145 of the second plurality of ramp members 140. In some embodiments, the centered lateral axes 135 of the first plurality of ramp members 130 may be parallel to the centered lateral axes 145 of the second plurality of ramp members.

The height of each ramp member may increase from the inner end 136, 146 to the peak height section 134, 144 and then taper to a shorter height at the outer end 132, 142. As a wheel/tire traverses a ramp member, the operator of a vehicle comprising the wheel/tire may feel the wheel/tire moving upward as the wheel/tire interfaces with the outer end 132, 142 before moving towards as the wheel/tire moves past the peak height section 134, 144 and down to the inner end 136, 146 before moving laterally across the upper surface 115 of the body member 110. This physical sensation of moving upwards, downwards, and then laterally may indicate to the operator that the wheel/tire is positioned on the dock 100. Accordingly, the height of the ramp member at the peak height section 134, 144 may be greater than a height of the body member 110. The peak height section 134, 144 may be within a range from 1.25 inches to 5 inches. In the present embodiment, the height of the peak height section 134, 144 is 2.75 inches.

The first and second pluralities of ramp members 130, 140 may be configured in number and positioning to facilitate the interlocking of adjacent docks 100 for vehicles having adjacent wheels/tires (i.e. so that two docks can be placed adjacent to one another and adjacent wheels/tires may both be positioned on the adjacent docks) and stacking of docks 100 when stored. In the present embodiment, the first plurality of ramp members 130 comprises eight (8) ramp members and the second plurality of ramp members 140 comprises seven (7) ramp members. These numbers are exemplary only and any number of ramp members is contemplated and included within the scope of the invention.

Figure 5:
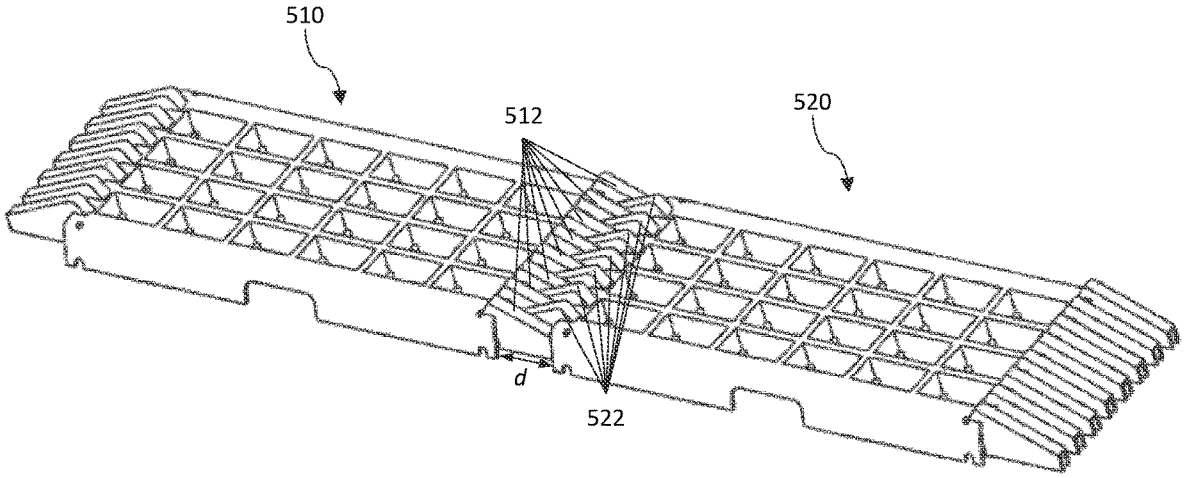
FIG. 5 is a perspective view of two docks according to the dock embodiment shown in FIG. 1 positioned such that tapered end members thereof are interspersed.

The ramp members may be configured to have a width and positioned so as to be spaced apart a sufficient distance to be positioned between ramp members of another dock 100. Specifically, a gap between adjacent ramp members may be greater than a width of the ramp members. For example, the first plurality of ramp members 130 defines seven (7) gaps 138 between adjacent ramp members of sufficient width such that the ramp members of the second plurality of ramp members 140 of another dock may be positioned partially within the gaps 138. Similarly, the second plurality of ramp members 140 may define six (6) gaps 148 between adjacent ramp members such that six of the ramp members of the first plurality of ramp members 130 of another dock may be positioned partially there within. The remaining two (2) ramp members of the first plurality of ramp members 130 may be positioned outside the outer ramp members 140', 140" of the second plurality of ramp members 140. Moreover, to facilitate the partial positioning of the ramp members 130, 140 within the gaps 138, 148 defined therebetween, the first plurality of ramp members 130 may be positioned so as to be longitudinally offset from the second plurality of ramp members 140. Such positioning applies both when two docks are positioned laterally adjacent to one another when in use or when positioned one on top of the other for stacking/storage. An example of two docks being positioned laterally adjacent to one another is shown in FIG. 5. There, a first dock 510 is positioned such that a first plurality of ramp members 512 thereof is interspersed with a second plurality of ramp members 522 of a second dock 520. As described above, the first plurality of ramp members 512 may be longitudinally offset from the second plurality of ramp members 522 to facilitate the interspersing of the ramp members 512, 522. A distance d the docks 510, 520 are positioned apart may be adjusted responsive to the distance apart the wheels intended to be positioned thereupon. The interspersing of the ramp members of the docks 510, 520 enables such adjusting. Moreover, when so positioned in a laterally adjacent orientation, the first dock 510 may for a straight line with the second dock 520.

Each ramp member may be configured to be sufficiently strong to permit the temporary placement of a wheel/tire thereupon and to facilitate the movement of the wheel there over onto the body member 110. In the present embodiment, each ramp member may comprise sidewalls 131, 141 and an upper wall 133, 143. The upper wall 133, 143 may be configured to facilitate the movement of the wheel/tire by providing a smooth surface that, when taken in conjunction with the other ramp members in the plurality of ramp members for that side of the dock 100, provides sufficient weight-bearing and frictional capacity to facilitate such movement. The sidewalls 131, 141 and upper walls 133, 143 may cooperate to define a void for each ramp member, reducing the amount of material used in fabrication of each ramp member while still providing sufficient structural integrity to provide the above-described capabilities. Each ramp member may have an outer dimension within a range from 0.25 inches to 1 inch. In the present embodiment, the ramp members may have an outer width of approximately 0.625 inches. Additionally, the gap defined between adjacent ramp members may be greater than the outer dimension of ramp members, and therefore may be within a range from slightly greater than 0.25 inches (e.g. 0.275 inches) to slightly greater than 1 inch (e.g. 1.025 inches). In the present embodiment, the gap is approximately 0.675 inches.

Figure 6:
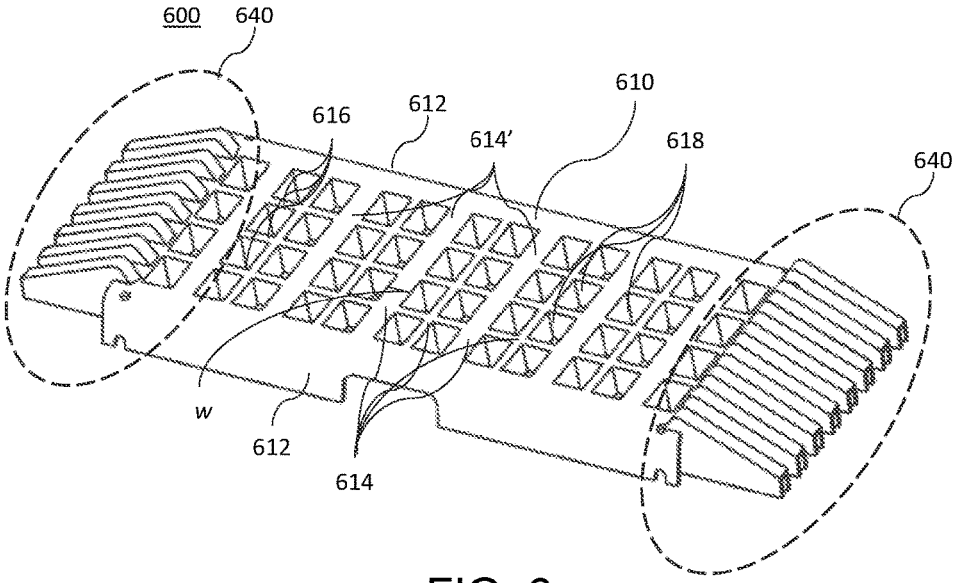
FIG. 6 is a perspective view of a dock according to another embodiment of the invention.
Figure 7:
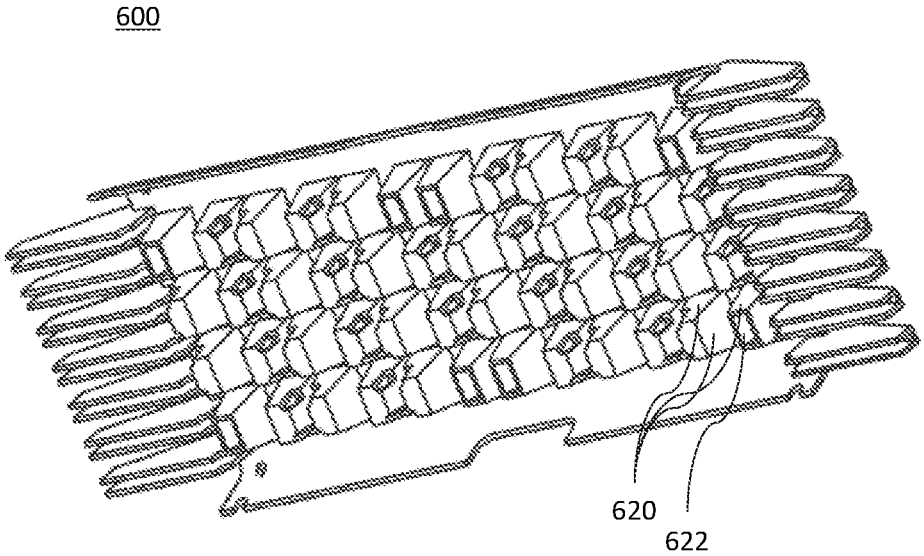
FIG. 7 is a lower perspective view of the dock of FIG. 6.

Referring now to FIGS. 6-7, a dock 600 according to another embodiment of the invention is presented. The dock 600 may be similar to the dock 100 of FIGS. 1-4, comprising a body member 610, first plurality of ramp members 630, and a second plurality of ramp members 640. In this embodiment, the body member 610 comprises a plurality of sidewalls 612 and a plurality of interior walls, specifically, a plurality of longitudinally-oriented walls 614 and a plurality of latitudinally-oriented walls 616. A subset of the plurality of longitudinally-oriented walls 614' may have a width w that is greater than the width of other longitudinally-oriented walls 614. In some embodiments, the ratio of the subset of longitudinally-oriented walls 614' to total longitudinally-oriented walls 614 may be within the range from 1:1.1 to 1:10. In the present embodiment, the ratio is 1:2. Additionally, the ratio of the widths of the subset of longitudinally-oriented walls 614' to the other longitudinally-oriented walls comprised by the plurality of longitudinally-oriented walls 614 may be within a range from 1.1:1 to 10:1. In the present embodiment, the ratio is 3:1. In some embodiments, the ratio is 1:1. Additionally, the width w of the subset of longitudinally-oriented walls 614' may be within a range from 0.125 inches to 1.5 inches. In the present embodiments, the width w is 1.125 inches. The width of the other longitudinally-oriented walls 614 and the latitudinally-oriented walls 616 may be within a range of 0.125 inches to 0.75 inches. In the present embodiment, their width is 0.375 inches.

Figure 4:
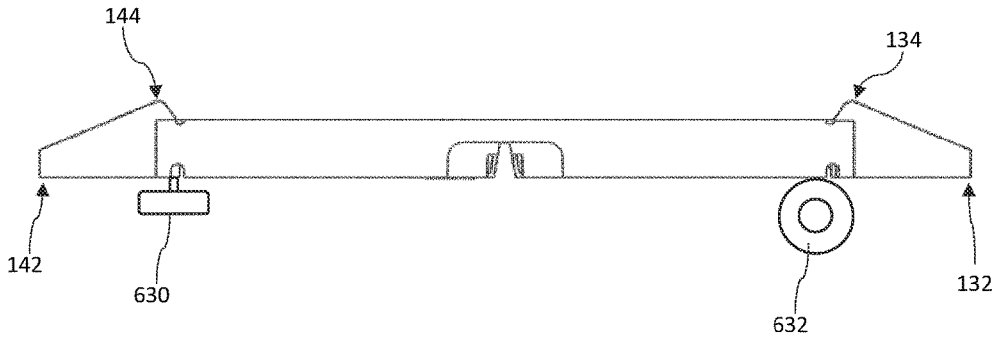
FIG. 4 is a side view of the dock of FIG. 1.

The dock 600 may further comprise a plurality of cells 618. The plurality of cells 618 may be configured to have dimensions that facilitate the positioning of a tire there upon. Cells 618 with too large dimensions may permit the undesired deformation of a tire positioned thereupon into the cells 618. In some embodiments, the plurality of cells may be dimensioned to have an upper width within a range of 0.5 inches to 3 inches and an upper length within a range of 0.75 inches to 4 inches. In the present embodiment, the upper width is 1.5 inches and the upper length is 1.75 inches. The cells 618 may be defined by a plurality of cell sidewalls 620. In at least one of the cells 618, the plurality of cell sidewalls 620 may define a lower aperture 622. The lower aperture 622 may be configured to permit another apparatus of the dock 600 to be positioned therethrough, thereby removably attaching the apparatus to the dock 600. Examples of such apparatuses include, but are not limited to, anti-skid feet, anti-slip feet, wheels, casters, apparatuses comprises a lower surface with a low coefficient of friction to facilitate sliding of the dock 600, anchoring structures, magnets, visible radiation devices such as LED devices, audio devices configured to emit audio signals upon detecting a load on the dock 600, pressure sensors operable to transmit a measured pressure responsive to a tire being positioned on the dock, and other devices. Exemplary apparatuses are shown in FIG. 4, depicting a foot 630 and a caster 632. In the present embodiment, four cells of the plurality of cells 618 have such an aperture. These cells are positioned at four corners of the array of the plurality of cells 618. It is contemplated and included in the scope of the invention that any number of cells having such an aperture may be comprised by the dock 600 and they may be distributed in any configuration, in a regular or non-regular fashion. Further, the remaining cells of the plurality of cells 618 may comprise an aperture similar to the apertures 119 of the dock 100 of FIGS. 1-5 above.

Figure 8:
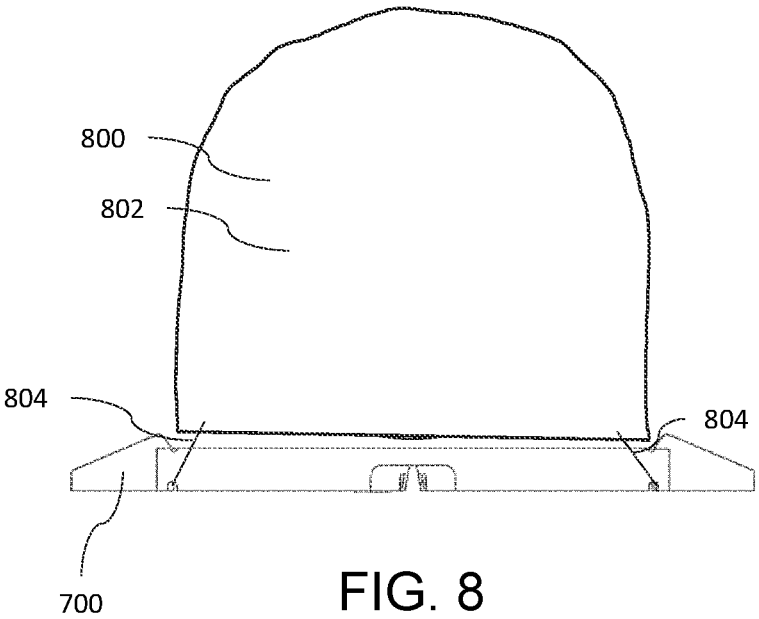
FIG. 8 is a side view of a dock and cover according to an embodiment of the invention.

Referring now to FIG. 8, another element of the invention is presented. In FIG. 8, a dock 700 is presented with a wheel cover 800 attached thereto. The wheel cover 800 may comprise a cover member 802 and one or more attachment members 804. The cover member 802 may be formed of a material and dimensioned to cover a tire that is positioned on the dock 700. As tires come in varying sizes, the cover member 802 may be dimensioned to fit relatively larger tires, such that when covering a relatively smaller tire the excess material may drape behind the tire. The attachment members 804 may be attached to the cover member 802 and configured to removably attach to the dock 700. Such removable attachment may permit the cover 800 to be detached while placing the dock 700 on the ground and positioning the tire on top of the dock, then attaching the cover 800 to the dock and covering the tire. The cover 800 may then be detached from the dock 700 and removed from the tire prior to moving the tire off the dock 700. Such an attachment member may be any length of material that may attach to the dock 700 and generally prevent the unintentional detachment therefrom, including flexible, rigid, elastic, and inelastic structures. Moreover, the attachment members 804 may attach at various places on the dock, including, for example, recesses formed in a lower surface of a sidewall thereof. Any means and method of attachment as is known in the art is contemplated and included within the scope of the invention, including, but not limited to, hooks, fasteners, snaps, magnets, latches, and the like.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

Thus the scope of the invention should be determined by the appended claims and their legal equivalents, and not by the examples given.

What is claimed is:

1. A wheel elevating dock comprising:

a body member;

a first plurality of ramp members attached to a first end of the body member and defining gaps between each ramp member of the first plurality of ramp members; and a second plurality of ramp members attached to a second end of the body member;

wherein the gaps defined by the first plurality of ramp members are configured to permit ramp members from a laterally adjacent wheel elevating dock to be positioned within the gaps;

wherein each ramp member of the first plurality of ramp members defines a centered lateral axis;

wherein each ramp member of the second plurality of ramp members defines a centered lateral axis; and wherein each of the centered lateral axes of the first plurality of ramp members are longitudinally offset from each of the centered lateral axes of the second plurality of ramp members.

2. The wheel elevating dock of claim 1 wherein the ramp members of the first and second pluralities of ramp members have a peak height section configured to have a height greater than a height of an upper surface of the body member.

3. The wheel elevating dock of claim 1 wherein the body member comprises:

a plurality of sidewalls; and a plurality of interior walls.

4. The wheel elevating dock of claim 3 wherein the plurality of sidewalls and the plurality of interior walls cooperate to define a plurality of cells.

5. The wheel elevating dock of claim 4 wherein a cell of the plurality of cells comprises an aperture configured to permit a flow of fluid out of the cell.

6. The wheel elevating dock of claim 5 wherein:

each cell comprises:

a plurality of cell sidewalls; and a cell lower wall that intersects at a lower end of adjacent cell sidewalls of the plurality of cell sidewalls; and the aperture is positioned at the intersection of the adjacent cell sidewalls and the cell lower wall.

7. The wheel elevating dock of claim 4 wherein the plurality of sidewalls and the plurality of interior walls are arranged in a grid.

8. The wheel elevating dock of claim 4 wherein at least one cell of the plurality of cells comprises:

a plurality of cell sidewalls; and a lower aperture defined by the plurality of sidewalls; and the wheel elevating dock further comprises one of a foot positioned within the lower aperture or a caster positioned within the lower aperture.

9. The wheel elevating dock of claim 3 wherein a sidewall of the plurality of sidewalls comprises a recess formed on a lower edge thereof.

10. The wheel elevating dock of claim 3 wherein the body member further comprises:

an upper surface; and an aperture formed in at least one of a sidewall of the plurality of sidewalls and/or the upper surface.

11. The wheel elevating dock of claim 3 wherein the body member further comprises:

an upper surface; and two pairs of apertures formed at opposing ends of the upper surface.

12. The wheel elevating dock of claim 3 wherein the plurality of interior walls comprises:

a plurality of longitudinally-oriented walls; and a plurality of latitudinally-oriented walls;

wherein a subset of the longitudinally-oriented walls have a width that is greater than widths of the other longitudinally-oriented walls and the latitudinally-oriented walls.

13. The wheel elevating dock of claim 1 wherein the second plurality of ramp members are configured to have a width and be positioned so as to fit within gaps defined by ramp members of another adjacent wheel elevating dock.

14. The wheel elevating dock of claim 1 further comprising a cover comprising:

a cover member configured to be positioned over a tire to shield at least a portion of the tire from the environment; and an attachment member attached to the cover member and configured to removably attach to the body member.

15. A wheel elevating dock comprising:

a body member comprising:

a plurality of sidewalls; and a plurality of interior walls;

the plurality of sidewalls and the plurality of interior walls defining a plurality of cells;

a first plurality of ramp members attached to a first end of the body member and defining gaps between each ramp member of the first plurality of ramp members; and a second plurality of ramp members attached to a second end of the body member;

wherein the gaps defined by the first plurality of ramp members are configured to permit ramp members from another adjacent wheel elevating dock to be positioned within the gaps;

wherein the second plurality of ramp members are configured to have a width and be positioned so as to fit within gaps defined by ramp members of a laterally adjacent wheel elevating dock;

wherein each ramp member of the first plurality of ramp members defines a centered lateral axis;

wherein each ramp member of the second plurality of ramp members defines a centered lateral axis; and wherein each of the centered lateral axes of the first plurality of ramp members are longitudinally offset from each of the centered lateral axes of the second plurality of ramp members.

16. The wheel elevating dock of claim 15 wherein the ramp members of the first and second pluralities of ramp members have a peak height section configured to have a height greater than a height of an upper surface of the body member.

17. The wheel elevating dock of claim 15 wherein a cell of the plurality of cells comprises:

a plurality of cell sidewalls;

a cell lower wall that intersects at a lower end of adjacent cell sidewalls of the plurality of cell sidewalls; and an aperture positioned at the intersection of the adjacent cell sidewalls and the cell lower wall.

18. The wheel elevating dock of claim 15 wherein at least one cell of the plurality of cells comprises:

a plurality of cell sidewalls; and a lower aperture defined by the plurality of sidewalls; and the wheel elevating dock further comprises one of a foot positioned within the lower aperture or a caster positioned within the lower aperture.

19. A wheel elevating dock comprising:

a body member comprising:

a plurality of sidewalls; and a plurality of interior walls;

the plurality of sidewalls and the plurality of interior walls defining a plurality of cells;

a first plurality of ramp members attached to a first end of the body member and defining gaps between each ramp member of the first plurality of ramp members;

a second plurality of ramp members attached to a second end of the body member; and at least one of a foot and/or a caster;

wherein the gaps defined by the first plurality of ramp members are configured to permit ramp members from an adjacent wheel elevating dock to be positioned within the gaps;

wherein the second plurality of ramp members are configured to have a width and be positioned so as to fit within gaps defined by ramp members of another laterally adjacent wheel elevating dock;

wherein a first cell of the plurality of cells comprises:

a first plurality of cell sidewalls;

a cell lower wall that intersects at a lower end of adjacent cell sidewalls of the first plurality of cell sidewalls; and an aperture positioned at the intersection of adjacent first cell sidewalls and the cell lower wall;

wherein a second cell of the plurality of cells comprises:

a second plurality of cell sidewalls; and a lower aperture defined by the second plurality of cell sidewalls;

wherein the at least one of a foot and/or a caster is positioned within the lower aperture;

wherein each ramp member of the first plurality of ramp members defines a centered lateral axis;

wherein each ramp member of the second plurality of ramp members defines a centered lateral axis; and wherein each of the centered lateral axes of the first plurality of ramp members are longitudinally offset from each of the centered lateral axes of the second plurality of ramp members.

* * * * *